US005478095A

United States Patent [19]

Marandel

[11] Patent Number: 5,478,095

[45] Date of Patent: Dec. 26, 1995

[54] ROLLER SKATE WITH INCLINED PLATE

[76] Inventor: Jean-Bernard Marandel, 4, rue de la République, 93450 l'Ile Saint-Denis, France

[21] Appl. No.: 438,033

[22] Filed: May 8, 1995

Related U.S. Application Data

[63] Continuation of Ser. No. 51,970, Apr. 26, 1993, abandoned.

[30] Foreign Application Priority Data

Apr. 27, 1992 [FR] France ..... 92 05163

[51] Int. Cl.[6] ..... A63C 17/02

[52] U.S. Cl. ..... 280/11.28; 280/11.19

[58] Field of Search ..... 280/11.19, 11.27, 280/11.28, 87.042

[56] References Cited

U.S. PATENT DOCUMENTS

| | | | |
|---|---|---|---|
| 2,664,295 | 12/1953 | Van Horn | 280/11.28 |
| 3,771,811 | 11/1973 | Bueno | 280/87.042 |
| 3,795,409 | 3/1974 | Cudmore | 280/87.042 |
| 3,862,763 | 1/1975 | Ware | 280/11.28 |
| 4,311,319 | 1/1982 | Snyder et al. | 280/11.28 |
| 4,363,494 | 12/1982 | Klawitter | 280/11.28 |
| 4,372,566 | 2/1983 | Smith | 280/11.28 X |
| 4,523,767 | 6/1985 | LePage | 280/11.19 |
| 4,915,399 | 4/1990 | Marandel | 280/11.28 |
| 5,029,882 | 7/1991 | Marandel | 280/11.2 |
| 5,326,115 | 7/1994 | Seltzer | 280/11.19 |

FOREIGN PATENT DOCUMENTS

| | | | |
|---|---|---|---|
| 2429604 | 1/1980 | France . | |
| 2633524 | 1/1990 | France | 280/11.28 |
| 2646613 | 11/1990 | France . | |
| 1952714 | 10/1970 | Germany . | |
| 84073 | 2/1920 | Switzerland . | |

*Primary Examiner*—Brian L. Johnson

*Attorney, Agent, or Firm*—Sughrue, Mion, Zinn, Macpeak & Seas

[57] ABSTRACT

Roller skates in which the sole plate has a downward inclination or tilt towards the front in relation to the ground. The inclination of the roller skate is due to the fact that at the front a so-called "semi-rigid" steering system 7 is used, and at the rear a spring steering system 7' or another raised semi-rigid steering system is used, the combination of which provides an angle of inclination of between 3° and 15° in the unloaded position of the plate, thereby improving the comfort of the roller skate user.

9 Claims, 6 Drawing Sheets

ROLLER SKATE WITH INCLINED PLATE

CROSS-REFERENCE TO RELATED APPLICATION

This application is a continuation of U.S. application Ser. No. 08/051,970 filed Apr. 26, 1993, and now abandoned.

BACKGROUND OF THE INVENTION

The present invention relates to an improvement in roller skates with steering systems having a shock-absorbing suspension spring and/or so-called "semi-rigid" (springless) steering systems.

More particularly, the object of the present invention is roller skates in which the sole plate is inclined or tilted downwardly towards the front in relation to the horizontal, at least in the non-charged (unloaded or relaxed) position, i.e., the position in which the sole plate is not loaded by the weight of a person.

The present invention relates both to roller skates and to skateboards of the type on which the user places both feet on the board, the movement of which he directs by inclining the board. These two types of devices will be designated hereinafter using the generic phrase "roller skates."

French Patent 2 610 208 (corresponding to U.S. Pat. No. 4,915,399); and its two additions Nos. 2 633 524 (corresponding to U.S. Pat. No. 5,029,882) and 2 646 613 have previously described roller skates having spring suspension systems on the front and rear axles, which have the advantage of appreciably absorbing the shocks and vibrations caused by the unevenness of the ground on the one hand and which, on the other hand, provide improved comfort for the skater.

In use, it has been noticed that the user of roller skates provided with a spring suspension at the front noticed a feeling of start-up difficulty or "sluggishness" due to the compression of the spring. This is particularly bothersome since the starting phase is very important in racing or when participating in competitions.

In order to overcome this disadvantage, which is both psychological and technical, it has been shown that for the front suspension, it is preferable to adopt a solution which is at least partially more rigid.

However, many trained skaters miss the horizontal arrangement of the unloaded sole plate. In effect, as soon as the skater puts on his skates, the spring suspension or suspensions compresses or compress under his weight (load) and the horizontal balance of the sole of the foot is broken. This results in a need to compensate for this "counter-slope" by means of muscular effort.

An attempt has therefore been made to give back to the skater a level of comfort which is comparable to that of ice skaters, whose boot contains a component for raising the heel.

Until now, skaters have overcome this disadvantage by placing in their boots heel pieces of the type used by persons needing them for arch conformation. It can easily be seen that this is only a makeshift solution.

SUMMARY OF THE INVENTION

Using the device which is the object of the present invention, the same advantage is achieved by making the plate slope downwardly forward, by means of the structure of front and rear suspensions. This has the advantages of not needing to place heel pieces in the boots and of thus preventing any arch or ankle muscle fatigue.

In addition, by selecting the cross-section of the suspension springs as a function of the weight of the user, the compression of the spring, and therefore the flexibility of the suspension, can be adjusted to the weight characteristics of the user.

During tests carried out with a view to achieving the desired result, it appeared useful to conceive two typical structures for these skates with an inclined plate, one containing a "semi-rigid" (springless) suspension at the front and a spring suspension at the rear, and the other containing a "semi-rigid" springless suspension both at the front and the rear. At this time, improvements Were made to the mounting and adjustment of the "semi-rigid" suspensions, as well as an increase in weight.

The object of the present invention, therefore, consists of a roller skate of the type comprising a boot whose sole is fixed on a plate, with said plate, in the non-charged (unloaded) position, sloping downwardly towards the front in relation to the horizontal (or, more generally, in relation to the ground), with said slope resulting from, —in a first embodiment, the use at the front of a so-called "semi-rigid" direction system, and at the rear of a shock-absorbing suspension spring direction (steering) system, —in a second embodiment, the use at the rear of another, raised, "semi-rigid" direction system.

Another object of the present invention is to provide a particular "semi-rigid" direction or steering system, which is composed of an upper cup locked into the plate by two holding stems, a lower cup and two washers or resilient cylinders, with the assembly being connected to the axle by means of a central screw which traverses the plate by screwing into a housing which is obliquely machined into the plate, with said central screw being blocked by means of a lateral screw traversing a housing machined into the plate, perpendicular to the axis of said plate, in a preferred embodiment.

A further object of the present invention is a particular suspension spring direction steering system, which is composed of an arm articulated in the plate by means of an axis which is perpendicular to the axis of the plate, on which two interposing discs are inserted between the surfaces of the plate and the opposite surfaces of the articulated arm, of two washers or resilient cylinders and a lower cup, with the assembly being connected to the rear axle by means of a central screw which traverses the articulated arm, with said central screw being blocked by means of a lateral screw traversing the articulated arm by screwing into a housing which is obliquely machined in said articulated arm, in a preferred embodiment.

These objects, as well as other characteristics and advantages, in particular with regard to the respective spacing of the rear wheels and the front wheels, and to the shape of the cups and washers or resilient cylinders, will appear in a more complete manner in the following description of two particular embodiments, which are given as non-limiting indications, by reference to the attached drawings, in which:

DESCRIPTION OF PREFERRED EMBODIMENTS

Figure 1:
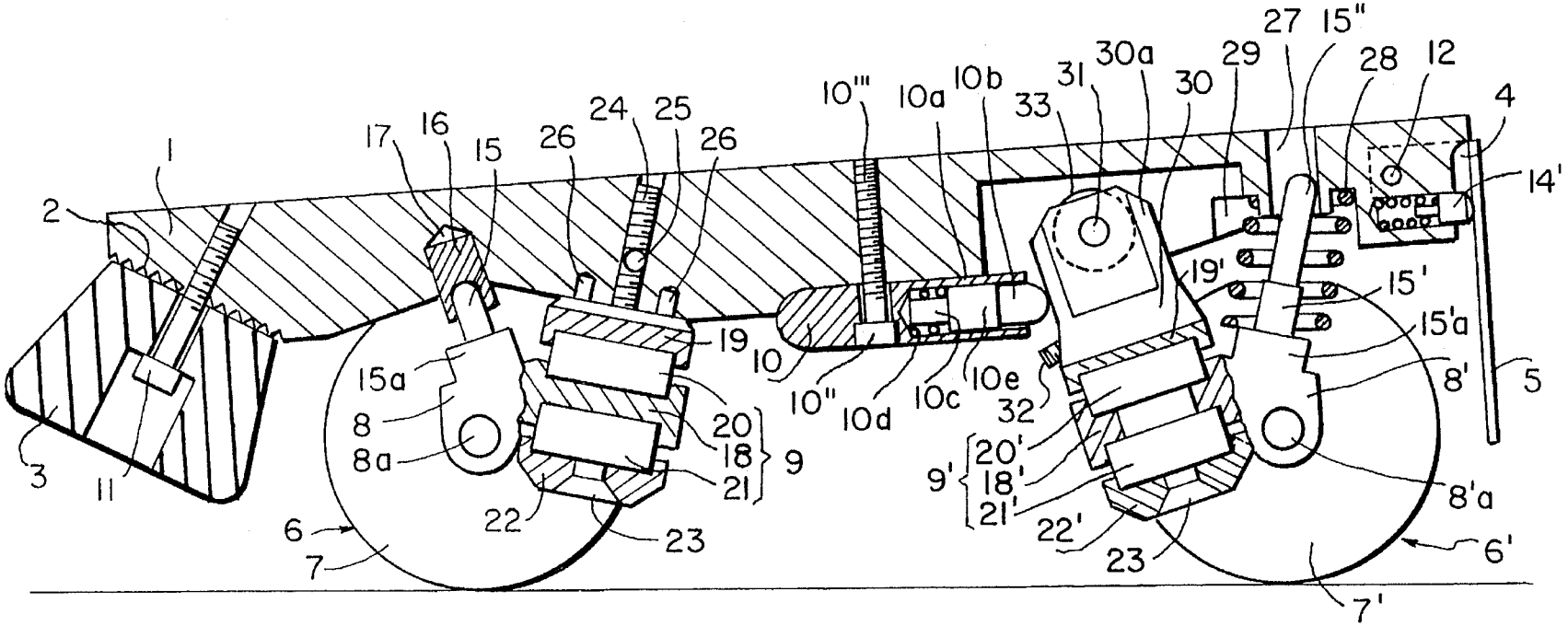
—FIG. 1 shows a partial axial cross-section of the plate to which the front and rear axles and the braking devices are connected.

FIG. 1 shows the plate 1 of the skate on which the boot will be fixed by means of a sole, which are not shown.

At the front, this plate contains an oblique, ribbed base 2, to which is fixed a brake or plug 3 and at the rear a vertical groove 4 intended for the housing of an additional braking device 5 which can be made to act on-the rear wheel train.

The skate further comprises front and rear rolling trains or carriages 6 and 6', each provided with a pair of wheels 7, 7', an axle 8, 8' and a direction system 9, 9'. Finally, a shock-absorbing mechanism is housed in a groove 10' provided in the lower surface of the plate, at mid-level. This mechanism is intended to absorb the return shock of the articulated arm of the rear roller train.

Figure 4:
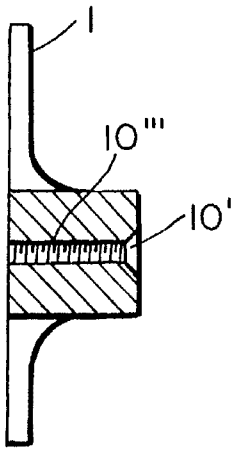
—FIG. 4 shows a cross-section taken along the line 4—4 coinciding with the axis X of FIG. 2.

The means for fixing the various skate components enumerated above will now be described, with reference also to FIGS. 2, 3 and 4, relating to various views of the plate.

Figure 3:
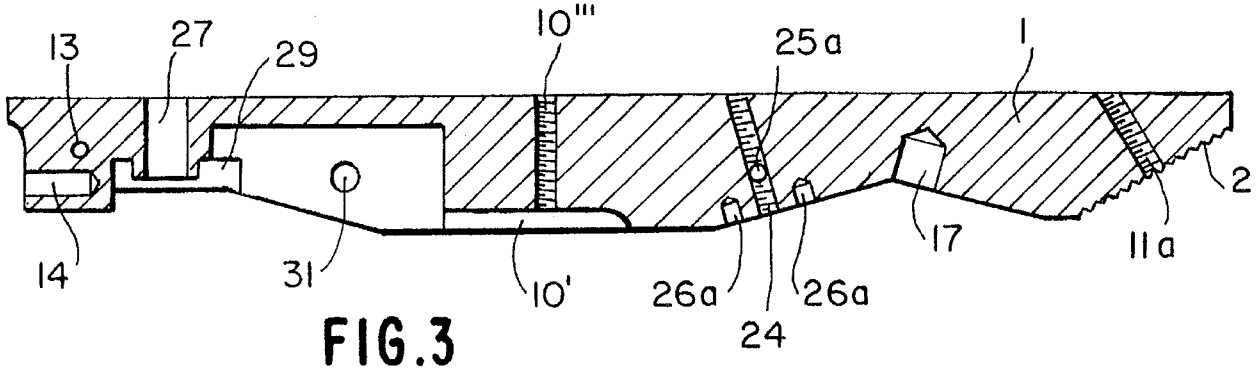
—FIG. 3 shows a cross-section of the plate alone taken along the line 3—3 coinciding with the axis X in FIG. 2.

The front brake 3 is fixed to the plate 1 by means of a threaded stem 11, which is screwed into a cylindrical opening 11*a* machined in an oblique direction which is oriented as shown in FIGS. 1 and 3.

The rear brake 5 is fixed to the plate by means of a stem 12 traversing a cylindrical opening 13 which is machined in a perpendicular direction to the axis X of the plate. There has further been provided a cylindrical housing 14 machined into the rear surface of the plate along the direction of the axis X of the plate, intended to receive a resilient device 14' which provides the rear return of the metal plate 5 which is of a generally trapezoidal shape, which enables braking of the skate to be carried out by the metal plate 5 coming into contact with the roller belt of the rear wheel couple.

The front roller train 6, composed of the pair of wheels 7, the axle 8 and the direction system 9, will be described with reference to FIGS. 1, 5*a* to 5*c*, 6, 7 and 8. It is fitted with a suspension system which can be called semi-rigid.

The front roller train 6 shown in FIG. 1 has a central component or axle 8 comprising a horizontal axis 8*a* on which are mounted two wheels 7 (not shown in FIG. 6), a centering finger 15 supported by a flange 15*a*, whose upper end is covered by an added cylindrical component 16 (or finger guide), which encases the centering finger 15 and extends beyond it. This cylindrical component 16 is inserted using force into a housing 17 which is machined into the lower surface of the plate.

The opposite end of the axle has the shape of an annular region or base 18, traversed by an orifice allowing the passage of a central screw 23.

The direction system of the front roller train is composed of an upper cup 19, two resilient washers 20 and 21, the above-identified annular region or base 18, and a lower cup 22.

This assembly is joined on the one hand to the axle 8, and on the other hand to the plate 1 by means of the central screw 23 which traverses it and is screwed into a housing 24 which is obliquely machined into the entire thickness of the lower surface of the plate. It can be seen that this central screw is blocked by means of a lateral screw 25, which perpendicularly traverses at 25*a* a thickening of the lower surface of the plate through half its thickness, thus preventing any accidental screwing or unscrewing under the effect of shocks or torsion stresses.

In addition, two holding stems 26, arranged on either side of the axis of the central screw, are an integral part of the upper cup 19 at its upper surface. They are placed in two housings 26*a* which are machined into the lower surface of the plate and thus provide locking of the direction system 9 into said plate The assembly of the four components central screw 23, lateral screw 25, pair of holding stems 26, ensure full and effective blocking of the front direction system in the plate.

The two resilient washers 20, 21 are sandwiched between the upper cup 19 and the lower and upper parts of the annular region 18 or base of the axle and the lower cup 22. The resilient washers 20, 21 are two synthetic or natural rubber cylinders.

The end surfaces of the lower resilient washer 21 are flat, with no grooves or notches being provided in the surfaces opposite the base of the annular region 18 and the lower cup 22.

The end surfaces of the upper resilient washer 20 can have notches or grooves which are housed, at the time of mounting the assembly, into notches or grooves 19*a*, 18*a* provided in the surfaces opposite the upper cup 19 and the upper part of the annular region 18 or base of the axle.

Depending on the degree of elasticity of the material of the upper resilient washer, the above-identified notches or grooves can be eliminated, with the plasticity of the rubber-like material supplying a deformation which will fill the notches or grooves provided in the cup and in the base.

The purpose of these notches or grooves 18*a*, 19*a*, respectively, is to rotatably lock the upper resilient washer 20 such that, during torsion of the resilient assembly under the effect of the action of the skater or of a shock on one or the other of the two wheels, a return torque can develop, which facilitates the return of the axle to its normal position after the shock or dscontinuance of the action of the skater.

It has not been seen to be necessary to provide the same groove and notch device for the lower resilient washer. However, there is no reason not to use this technique therein and it would increase the recall effect without damage.

The rear roller train 6', composed of the pair of wheels 7', the axle 8' and the direction system 9', will be described with reference to FIGS. 1, 9, 10*a* to 10*c*, 11 and 12. It is provided with a spring suspension system of the type described in French Patent No. 2 610 208.

The rear roller train 6' shown in FIG. 1 has a central component or axle 8' containing a horizontal axis 8'*a* on which are mounted two wheels 7' (not shown in FIG. 11), a centering finger 15' supported by a flange 15'*a*, and longer than that of the front roller train, whose upper end is extended by a stem 15", guided inside the centering stem with an oblong cross-section 27 machined in the rear part of the lower surface of the plate 1. A spring 28 surrounds the centering finger 15' and its stem 15". This spring takes support on the one hand on the base of the centering finger, and on the other hand on the bottom of the annular housing 29 which surrounds the above-identified centering stem. The opposite end of the axle has the shape of an annular region or base 18', traversed by an orifice allowing the passage of a central screw 23'.

The direction or steering system of the rear roller train is composed of an articulated arm 30, two resilient washers 20' and 21', the above-identified annular region or base 18', and a lower cup 22'.

This assembly is joined on the one hand to the axle 8' by means of the central screw 23' which traverses it, and on the other hand to the plate 1 by means of the axle 31 which fixes the upper end of the articulated arm to the plate. It will be noted that the central screw which traverses the articulated arm is blocked by means of a lateral screw 32, arranged obliquely in a housing 32' which is machined into the articulated arm 30 and which exits into the threaded housing 23'*a* of the central screw 23'. In this manner, by screwing said lateral screw 32, the end of which engages the threads of the central screw 23', blockage of said central screw is ensured.

The two resilient washers 20', 21', are sandwiched between the base 19' of the articulated arm 30, the lower and upper surfaces of the annular region 18' or base of the axle and the lower cup 22'. The resilient washers 20', 21' are two synthetic or natural rubber cylinders.

The end surfaces of the lower resilient washer 21' are flat, with no grooves or notches also being provided in the surfaces opposite the lower part of the annular region 18' of the axle on the one hand and the lower cup 22' on the other hand.

The end surfaces of the upper resilient washer 20' may have notches or grooves which are housed, at the time of mounting the assembly, into notches or grooves 18'*a*, 19'*a* provided in the surfaces opposite the upper part of the annular region 18' of the axle on the one hand and in the base 19' of the articulated arm 30, which serves as the upper cup for the rear roller train.

Just as for the similar assembly of the front roller train and as a function of the degree of elasticity of the material from which the upper resilient washer is made, the above-identified notches or grooves can be eliminated. Although there is no provision for the same notched or grooved device for the lower resilient washer in the embodiment described, there is nothing to prevent using that technique therein.

Figure 2:
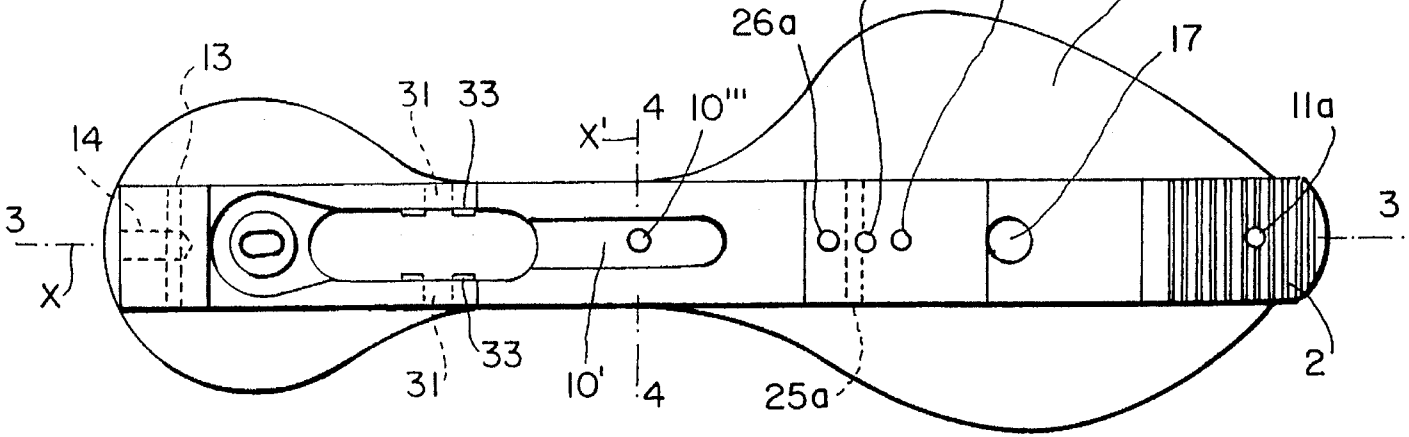
—FIG. 2 shows a view from below the plate.
Figure 10A:
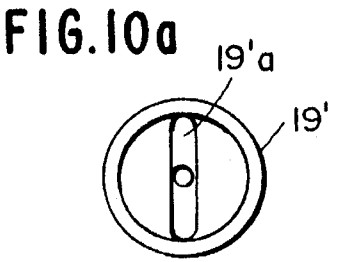
—FIGS. 10*a*, 10*b* and 10*c* respectively show a view from below, a cross-section along the line 10*b*—10*b* of the axis V and a view from above, of the articulated arm of FIG. 9.
Figure 10B:
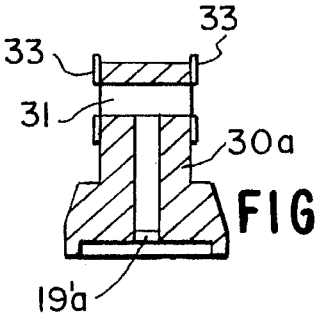
Figure 10C:
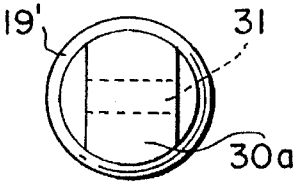
Figure 9:
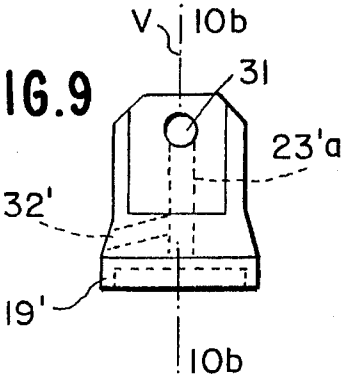
— FIG. 9 shows a side view of the articulated arm of the rear axle.

Looking at FIGS. 1, 2 and 10*b*, it will be noted that on the surfaces 30*a* of the upper end of the articulated arm 30 which is opposite the opposing surfaces of the plate 1, two interposition washers 33 have been inserted on axle 31, in order to prevent direct contact between the articulated arm 30 and the plate, which contact could generate undesirable friction insofar as they could cause grinding of the articulated arm.

If the plate 1 and the-articulated arm 30 are both made of plastic, a metal or TEFLON (a polymer of tetrafluorethylene) interposition washer 33 (which could be made of steel or any other metal) is interposed between their opposite surfaces, with the thickness of said washer being approximately on the order of 1/10 mm.

If the plate 1 and the articulated arm 30 are both made of metal, a steel or TEFLON interposition washer 33 is interposed between their opposite surfaces.

It can therefore be seen that the plate 1 can be made either of metal or of plastic. The same is true for the articulated arm 30, and the two components need not be made from the same material.

Figure 6:
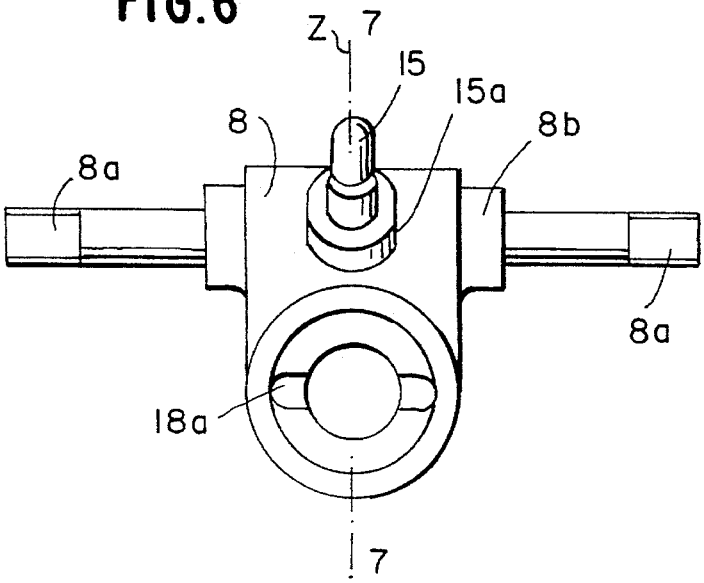
—FIG. 6 is a front view of the front axle.
Figure 7:
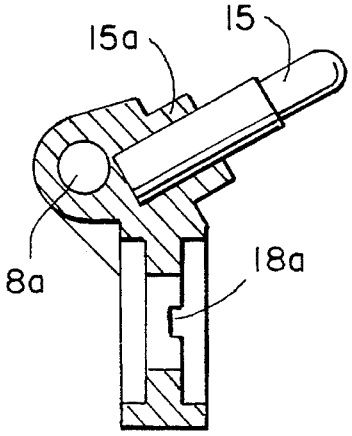
—FIG. 7 is a cross-section along the 7—7 coinciding with the axis Z of FIG. 6.
Figure 8:
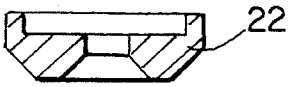
—FIG. 8 shows an axial cross-section of the lower cup of the device for holding the resilient washers of the rear axle direction system.
Figure 11:
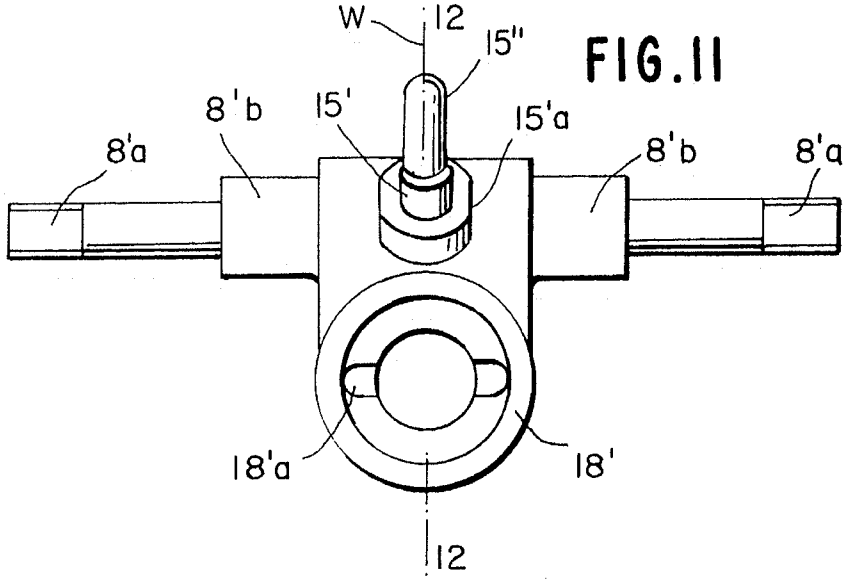
—FIG. 11 shows a front view of the rear axle.
Figure 12:
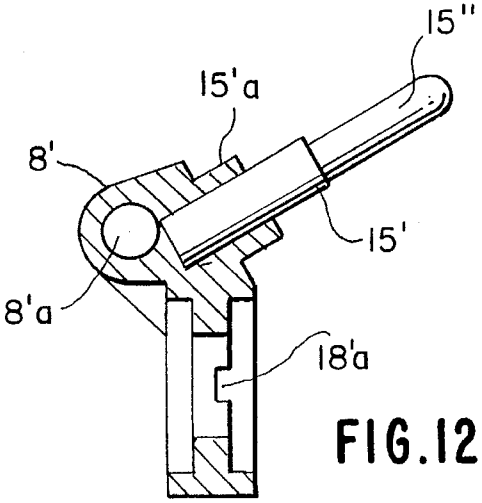
—FIG. 12 shows a cross-section along the line 12—12 coinciding with the axis W of FIG. 11.

Turning now to FIGS. 6 and 11, which show respectively a view of the front axle 8 and a view of the rear axle 8', it will be noted that the axes 8*a* and 8'*a* respectively of axles 8 and 8' are of different lengths. Axis 8'*a* is longer than axis 8*a* due to the presence of a shoulder 8'*b* which is longer than shoulder 8*b*, which carries component 8'*a* (the homologue of component 8*a*) on which the ballbearing roller of each wheel is mounted back towards the exterior. In this manner, a foundation for the rear wheel train 7' is produced which is higher than that of the front wheel train 7, which has the effect of providing better stability for the user.

Tests which have been conducted with users of the present model of roller skates have concluded that, for the skater's balance particularly after a jump, the preferable angle of downward inclination towards the front, in the unloaded position, should be between 3° and 15° in relation to the horizontal (or more generally in relation to the ground) and, preferably, should be between 5° and 10°.

This angle of inclination results from the fact that the centering finger 15' and its stem 15" of the rear axle 8' is longer than the corresponding part 15 of the front axle 8 on the one hand, and from the dimensional characteristics of the upper end 30*a* of the articulated arm 30 on the other hand. These two parameters combine to ensure an increased elevation of the rear part of plate 1 in relation to the front part.

This increased elevation therefore obviates the need to place heel pieces in the boots for those individuals who would need them for reasons of conformation or, more generally, to ensure better comfort for the user by preventing muscle fatigue.

Furthermore, during a jump, the forces received on landing by the rear suspension spring create compression of the spring which for a moment is greater and which, in the absence of the system which is the object of the present invention, place the front of the foot in a high position, thus putting the user in an unbalanced position, with the possibility of a bad landing.

In addition to its employment for conventional use, this new model of skate, comprising a device with a sole plate downwardly inclined towards the front, can therefore be used to advantage in competitions and also for jumps, in which the problems of landing are especially important.

The shock-absorbing system 10 using a resilient stop which is intended to absorb the return shock of the articulated arm 30 of the rear roller train will not be described in detail as this mechanism has already been the object of one part of the device described in the first Certificate of Addition No. 2 633 524. It will simply be noted, in the present alternative embodiment, that it is composed of a cylindrical envelope 10*a*, which is placed into a hemicylindrical groove 10' provided in the median part of the lower surface of the plate, with said envelope being fixed to the plate by means of a screw 10" which traverses the entire thickness of the plate at 10'''. A plastic plug 10*b* is housed in a cylindrical chamber 10*c* of the envelope 10*a*, with a spring 10*d* being interposed in the chamber 10*c* between the bottom thereof and a reinforcement 10*e* of the body of the plug 10*b*. By seating the periphery of the cylindrical envelope 10*a*, the stop plug 10*b* of the articulated arm of the axle is held in the cylindrical envelope, with only the end (or finger) 10*f* projecting under the thrust of spring 10*d*.

Figure 13:
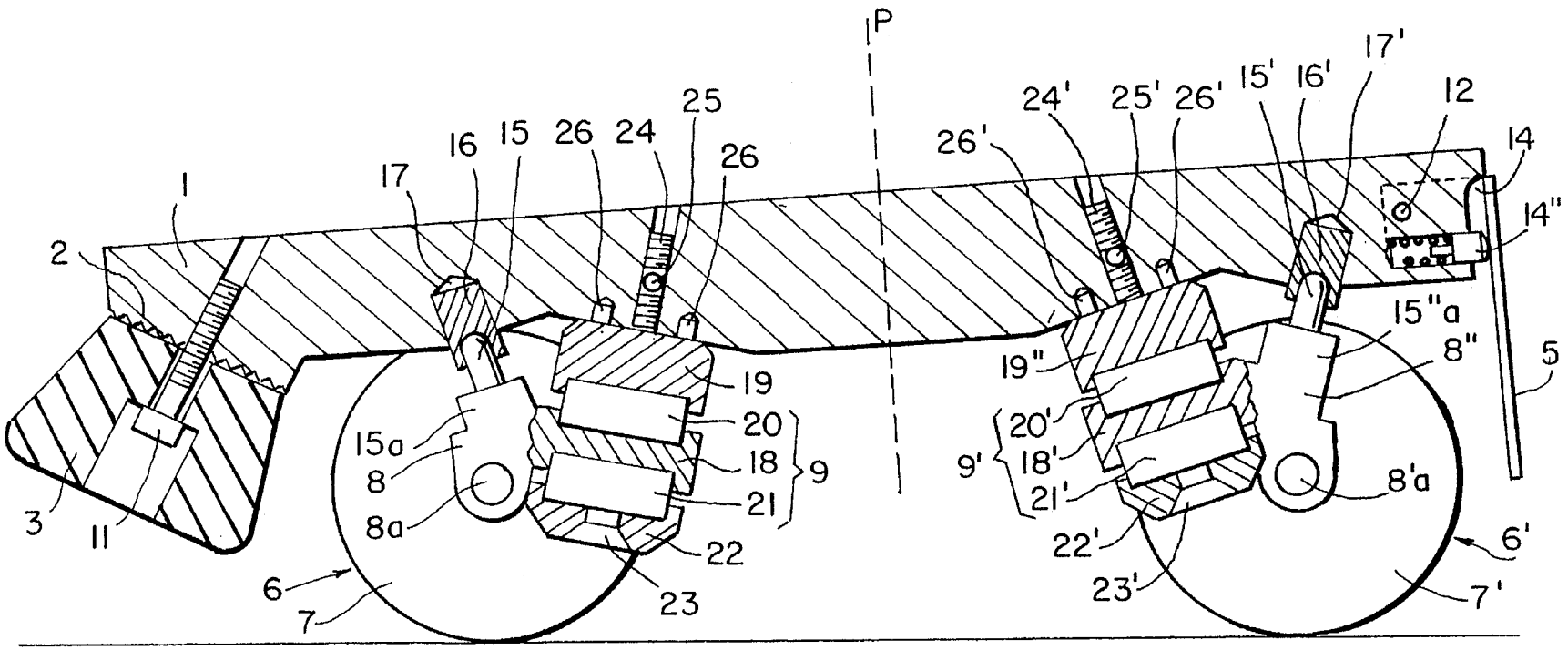
—FIG. 13 shows a partial axial cross-section of another embodiment of the plate, to which are connected identical front and rear axles.
Figure 14:
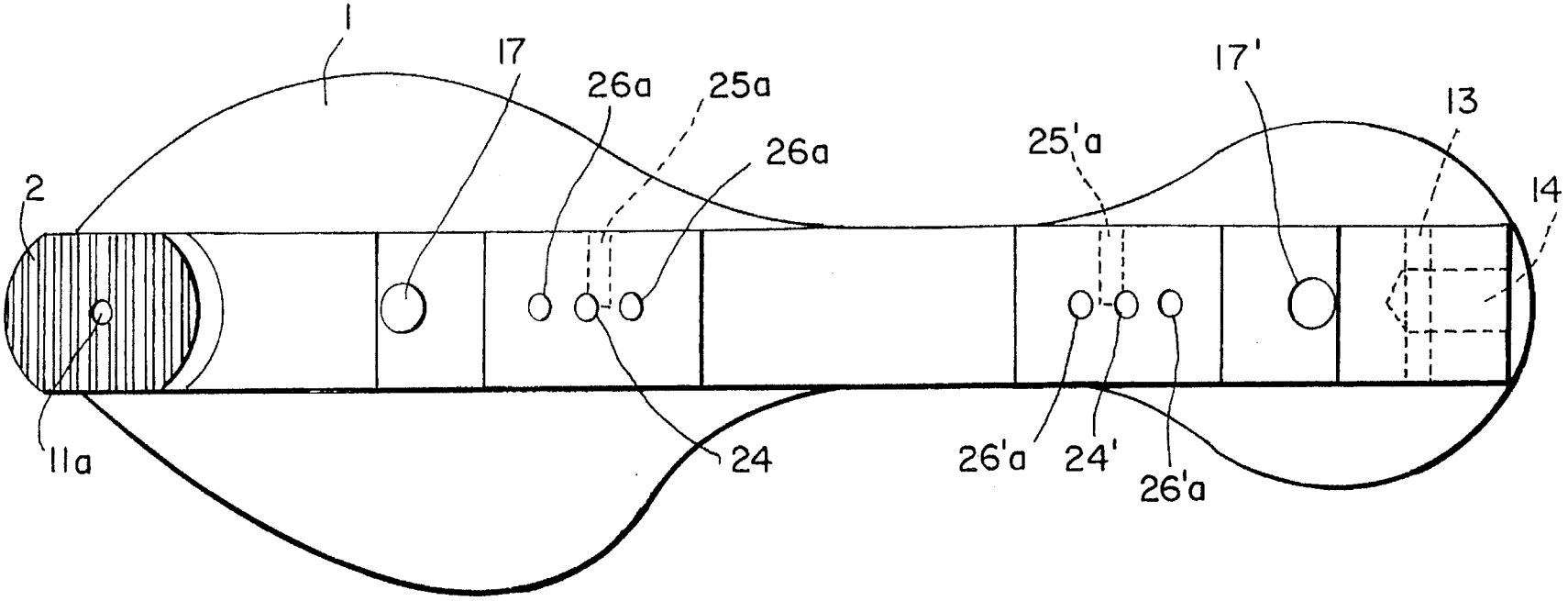
—FIG. 14 shows a view from below of the plate corresponding to the embodiment of FIG. 13.

Referring to FIGS. 13 and 14, a second embodiment of a roller skate can be seen, of the type comprising a sole plate 1 which, in the unloaded position, inclines or tilts downwardly towards the front in relation to the horizontal (or more generally in relation to the ground), with said inclination coming from the use at the front of a so-called "semi-rigid" direction (steering) system and at the rear of a raised "semi-rigid" direction (steering) system.

It will be noted that all the identical parts from the first and second embodiments have the same reference numerals as in FIGS. 1 and 13 on the one hand and FIGS. 2 and 14 on the other hand. Consequently, there will be no description relative thereto.

It will be sufficient therefore to describe the rear, raised semi-rigid direction system to show the differences in relation to the front semi-rigid direction system.

The direction (steering) system of the front roller train of FIG. 13 is identical to that of FIG. 1, except that, in the alternative embodiment shown, the upper cup 19" has an increased thickness in relation to the upper cup 19 shown in FIG. 1.

The direction (steering) system of the rear roller train of FIG. 13 is substantially identical to that of the direction of the front roller train. The two systems are mounted in the plate 1 with substantially symmetrical inclinations in relation to a median plane P, with housings 17, 24 and 26*a* being machined obliquely along inclinations which are symmetrical to those of housings 17', 24', and 26'*a* in relation to said median plane.

The inclination of the plate 1 is obtained by means of the geometry of the rear axle 8", which is different from that of the front axle 8 because of a flange 15"*a* which is higher than the flange 15*a* of said front axle 8. This geometrical characteristic ensure the raising of the rear part of the plate 1.

Figure 5A:
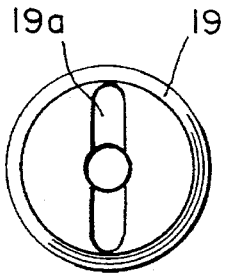
—FIGS. 5*a*, 5*b* and 5*c* respectively show a view from below, a cross-section taken along the line 5*b*—5*b* coinciding with the axis Y in FIG. 5*c* and a view from above of the upper cup of the device for holding the resilient washers of the front axle direction system.
Figure 5B:
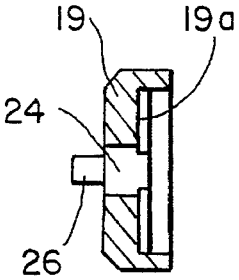
Figure 5C:
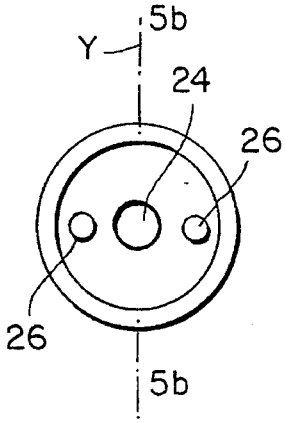

Thus, as an alternative, a thin upper cup 19 could be provided at the front, as in the solution shown in FIG. 1 and in FIGS. 5*a* to 5*c*, and an upper cup 19" with said increased thickness at the rear. At the rear there could also be a thin upper cup, with the raising being further provided by the height of the flange 15'*a* which is selected at an appropriate size in relation to that of flange 15*a* of the front direction system.

Finally, it can be noted that the double semi-rigid structure can be applied to a skateboard (roller board) as well as to the structure with a semi-rigid direction at the front and a shock-absorbing spring suspension at the rear. Of course, the front and rear braking components are not part of the skateboard device.

It is obvious that the invention is not strictly limited to the chosen embodiments and it is possible to consider other alternatives without, however, departing from the framework of the invention.

What is claimed is:

1. A roller skate comprising: a pair of front wheels and a pair of rear wheels, respectively mounted on a front end and a rear end of the skate and adapted to engage the ground; and a sole plate (1) having a planar upper surface, adapted to be fixed to the sole of a boot having a heel, and a planar lower surface parallel to said upper surface; wherein said plate (1), in an unloaded position, has a downward inclination towards the front end in relation to a horizontal surface of the ground such that both said upper and lower surfaces have said downward inclination, and wherein, for creating said inclination, said skate comprises, at only the from end, a from "semi-rigid" springless steering system, and, at only the rear end a shock-absorbing suspension spring rear steering system wherein the from "semi-rigid" steering system comprises a front upper cup (19) having two integral holding stems (26) engaged in two corresponding housings (26*a*) in said sole plate, thereby locking said front upper cup and said front steering system to said sole plate; a front lower cup (22); and first upper and lower resilient washers (20, 21) arranged on either side of a first annular region (18) of a front wheel axle (8), said front semi-rigid steering system being connected to the front wheel axle (8).

2. The roller skate of claim 1, said front semi-rigid steering system being connected to the from wheel axle (8) by a first central screw (23) which traverses the plate (1) and which is screwed into a first housing (24) obliquely machined into the plate (1), said from "semi-rigid" steering system further comprising a first lateral screw (25) traversing the plate (1) and being screwed into a second housing (25*a*) machined into the plate (1) so that said first central screw (23) is blocked by abutment against said first lateral screw (25).

3. The roller skate of claim 2, wherein the shock-absorbing suspension spring rear steering system comprises: an arm (30) articulated in the plate by an axle (31) on which two interposition washers (33) are inserted between surfaces of the plate and opposite surfaces of the articulated arm (30);i a rear upper cup (19'); a rear lower cup (22'); and second upper and lower resilient washers (20', 21') which are arranged on either side of a second annular region (18') of a rear wheel axle (8') and which are sandwiched between said rear upper and lower cups (19', 22'); said shock-absorbing suspension spring rear steering system being connected to the rear wheel axle (8').

4. The roller skate of claim 3, wherein said shock-absorbing suspension spring rear steering system is connected to the rear wheel axle (8) by a second central screw (23') which traverses the articulated arm (30), and further comprising a second lateral screw (32) which obliquely traverses the articulated arm (30), and which is screwed into a third housing (32') obliquely machined in the articulated arm so that said second central screw (23') is blocked by abutment against said second lateral screw (32).

5. The roller skate of any one of claims 1 to 3 or 4 wherein the rear wheels are separated by a distance which is greater than that between the front wheels.

6. The roller skate of claims 4, wherein the front and rear upper cups (19, 19') contain grooving or notches in a surface opposite the first and second upper resilient washers (20, 20'), and upper surfaces of the first and second annular regions (18, 18') of the front and rear axles (8, 8') contain grooving and notches (18*a*, 18'*a*) in which said first and second upper washers (20, 20') are housed in a fixed manner, thus enabling creation of a return-torque under the effect of torsional stress applied by a skater.

7. The roller skate of claim 6, wherein the rear upper cup (19') of the articulated arm (30) opposite the second upper resilient washer (20') contains grooving or notches (30*a*).

8. The roller skate of claim 1, 2, 3, 4 or 6, wherein the inclination of the plate, resulting from the front "semi-rigid" steering system and the shock-absorbing suspension spring rear steering system is between 3° and 15° in the unloaded position.

9. The roller skate of claim 8, wherein the inclination of the plate is between 5° and 10° in the unloaded position.

* * * * *